US011627782B2

(12) United States Patent
Drone

(10) Patent No.: US 11,627,782 B2
(45) Date of Patent: Apr. 18, 2023

(54) SHOE TREE DEODORIZER

(71) Applicant: Frederek Drone, Lawrence, KS (US)

(72) Inventor: Frederek Drone, Lawrence, KS (US)

( * ) Notice: Subject to any disclaimer, the term of this patent is extended or adjusted under 35 U.S.C. 154(b) by 165 days.

(21) Appl. No.: 17/203,570

(22) Filed: Mar. 16, 2021

(65) Prior Publication Data

US 2022/0295944 A1 Sep. 22, 2022

(51) Int. Cl.
*A43D 3/14* (2006.01)

(52) U.S. Cl.
CPC ..... *A43D 3/1491* (2013.01); *A43D 3/1475* (2013.01)

(58) Field of Classification Search
CPC .... A43D 3/1433; A43D 3/1441; A43D 3/145; A43D 3/1458; A43D 3/1466; A43D 3/1475; A43D 3/1483; A43D 3/1491
See application file for complete search history.

(56) References Cited

U.S. PATENT DOCUMENTS 1,469,238 A * 10/1923 Newlin ..... A43D 3/1475 12/117.4
3,435,475 A * 4/1969 Max ..... A43D 3/1475 12/117.4
4,718,135 A * 1/1988 Colvin ..... A43D 3/1466 12/114.2
6,675,421 B1 * 1/2004 Hsu ..... A43D 3/1491 12/128 B
D903,292 S 12/2020 Drone
2008/0210770 A1 * 9/2008 Dever ..... A43D 3/1491 36/71

FOREIGN PATENT DOCUMENTS

KR 101692202 B1 * 1/2017

* cited by examiner

*Primary Examiner* — Ted Kavanaugh

(57) ABSTRACT

A shoe tree deodorizer is an apparatus that enables users to deodorize and refreshen footwear and also helps to retain the footwear's shape. The apparatus may include a toe shaper, a heel shaper, a bridging support, a deodorant housing, a ventilation mechanism, and a quantity of deodorant. The toe shaper and the heel shaper retain the shape of the footwear by filling the space within the heel and the toe sections of the footwear, respectively. The bridging support enables the adjustment of apparatus to fit inside the footwear and provides the structural support for the toe shaper and the heel shaper to retain the shape of the footwear. The deodorant housing contains the quantity of deodorant to be released for deodorizing and refreshing the footwear. Furthermore, the ventilation mechanism enables the dispersal of the quantity of deodorant throughout the footwear or towards a specific area of the footwear.

20 Claims, 12 Drawing Sheets

SHOE TREE DEODORIZER

FIELD OF THE INVENTION

The present invention generally relates to footwear accessories and deodorizing products. More specifically, the present invention is a shoe tree equipped with deodorizing means.

BACKGROUND OF THE INVENTION

Air fresheners or deodorizers come in different types and sizes designed to fit in different objects. Many are available specifically for footwear to help manage bad odors trapped in the footwear. For example, multiple shoe deodorizers are available that help users manage the bad odors or even get rid of the odors. These shoe deodorizers are generally small packages that can be opened or unwrapped and placed within the desired footwear. Unfortunately, there is usually nothing within the footwear that keeps the deodorizer in place, leaving the deodorizer free to roll inside the footwear and even fall out of the footwear when the footwear is being carried around. There are other footwear accessories with deodorizing means designed to fit within the footwear without having the device moving inside the footwear or falling out of the footwear. For example, some deodorizing inserts are available that stay in place within the shoe due to friction. Likewise, some shoe trees are available that are made from deodorizing material that helps manage bad odors. However, the deodorizing material of these inserts wear out over time, requiring the user to replace them periodically.

An objective of the present invention is to provide a shoe tree deodorizer designed to help maintain the shape of the footwear while also deodorizing and refreshing the footwear. The present invention deodorizes and refreshens the footwear and helps extend the life of the footwear by retaining its shape. Another objective of the present invention is to provide a shoe tree deodorizer with a ventilation mechanism that traps moisture to further eliminate bad odors caused by the collected moisture within the footwear. Another objective of the present invention is to provide a shoe tree deodorizer that is highly adjustable to fit on the desired footwear and helps the user to target a specific area for deodorizing. Additional features and benefits of the present invention are further discussed in the sections below.

SUMMARY OF THE INVENTION

The present invention is a shoe tree deodorizer that deodorizers and refreshens footwear while retaining the shape of the footwear. The shoe tree deodorizer is an adjustable structure that fits on different sizes of footwear by utilizing a bridging support with different means of length adjustment. For example, the bridging support can be a flexible structure that can be squeezed into the footwear or a length-adjustable structure that can be shortened or elongated to fit a specific footwear size. In addition, the shoe tree deodorizer can be designed to fit in different footwear types, such as sneakers or boots. The shoe tree shaper can be designed to match the same ornamental design of the footwear, with the heel shaper and the toe shaper of the shoe tree shaper having the same logos, graphics, etc. Furthermore, the deodorizer of the present invention is provided in a deodorant housing that can repositioned along the bridging support to target a specific area within the footwear. The deodorizer can be provided in sponge-like material inside the deodorant housing along with a ventilation mechanism that enables moisture to be captured in the sponge-like material to further mitigate any bad odors caused by trapped moisture within the footwear.

DETAILED DESCRIPTION OF THE INVENTION

All illustrations of the drawings are for the purpose of describing selected versions of the present invention and are not intended to limit the scope of the present invention.

Figure 1:
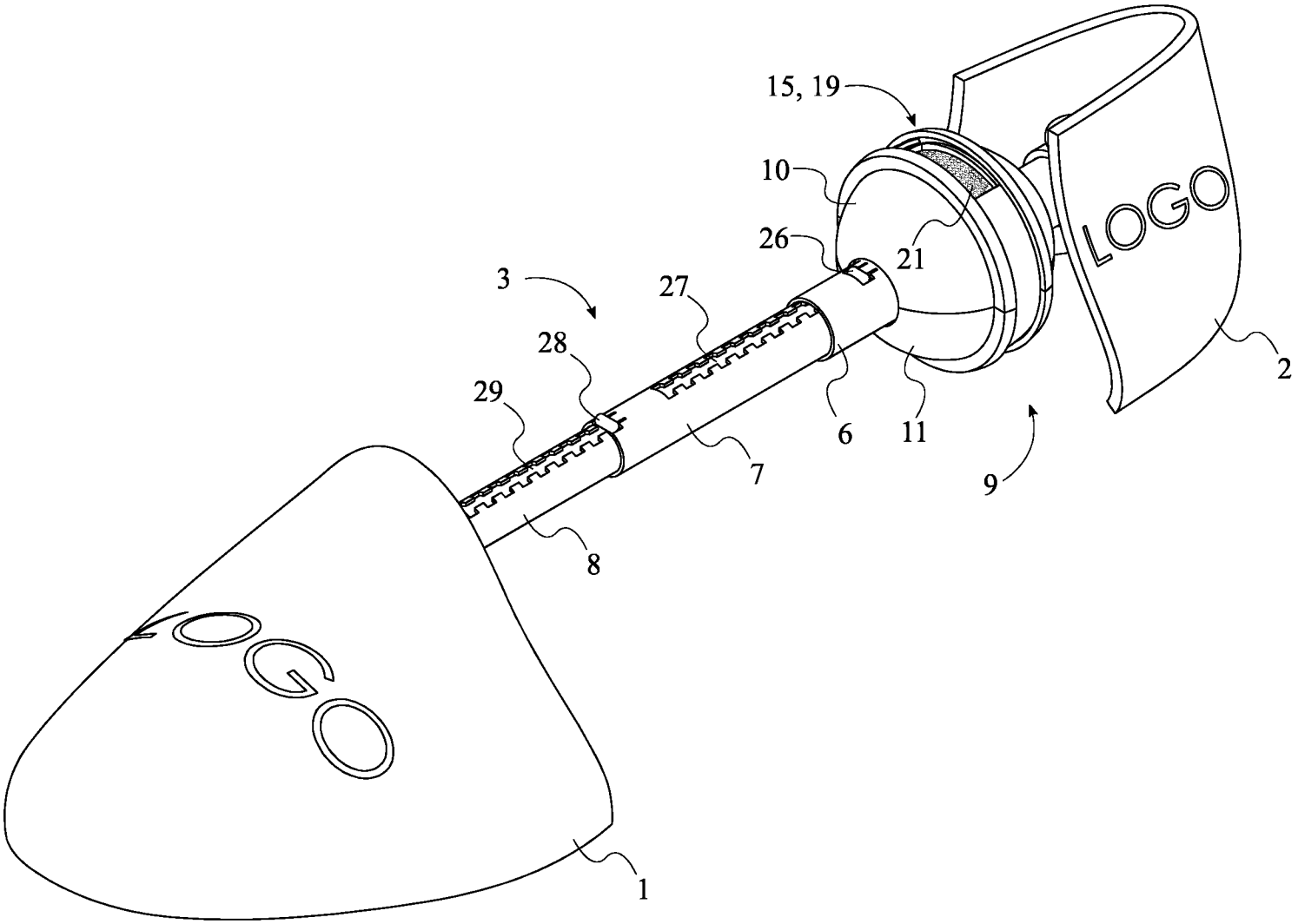
FIG. 1 is a front top perspective view showing the present invention, wherein the shoe tree deodorizer is shown in an expanded configuration.

The present invention is a shoe tree deodorizer that enables users to deodorize and refreshen footwear and also to retain the footwear's shape. As can be seen in FIG. 1, the present invention may comprise a toe shaper 1, a heel shaper 2, a bridging support 3, a deodorant housing 9, at least one ventilation mechanism 15, and a quantity of deodorant 21. The toe shaper 1 and the heel shaper 2 retain the shape of the footwear by filling the space within the toe and the heel sections of the footwear, respectively. The bridging support 3 enables the adjustment of the present invention to fit inside the footwear and provides the structural support for the toe shaper 1 and the heel shaper 2 to retain the shape of the footwear. The deodorant housing 9 contains the quantity of deodorant 21 to be released for deodorizing and refreshing the footwear. Further, the at least one ventilation mechanism 15 enables the dispersal of the quantity of deodorant 21 throughout the footwear or towards a specific area.

Figure 3:
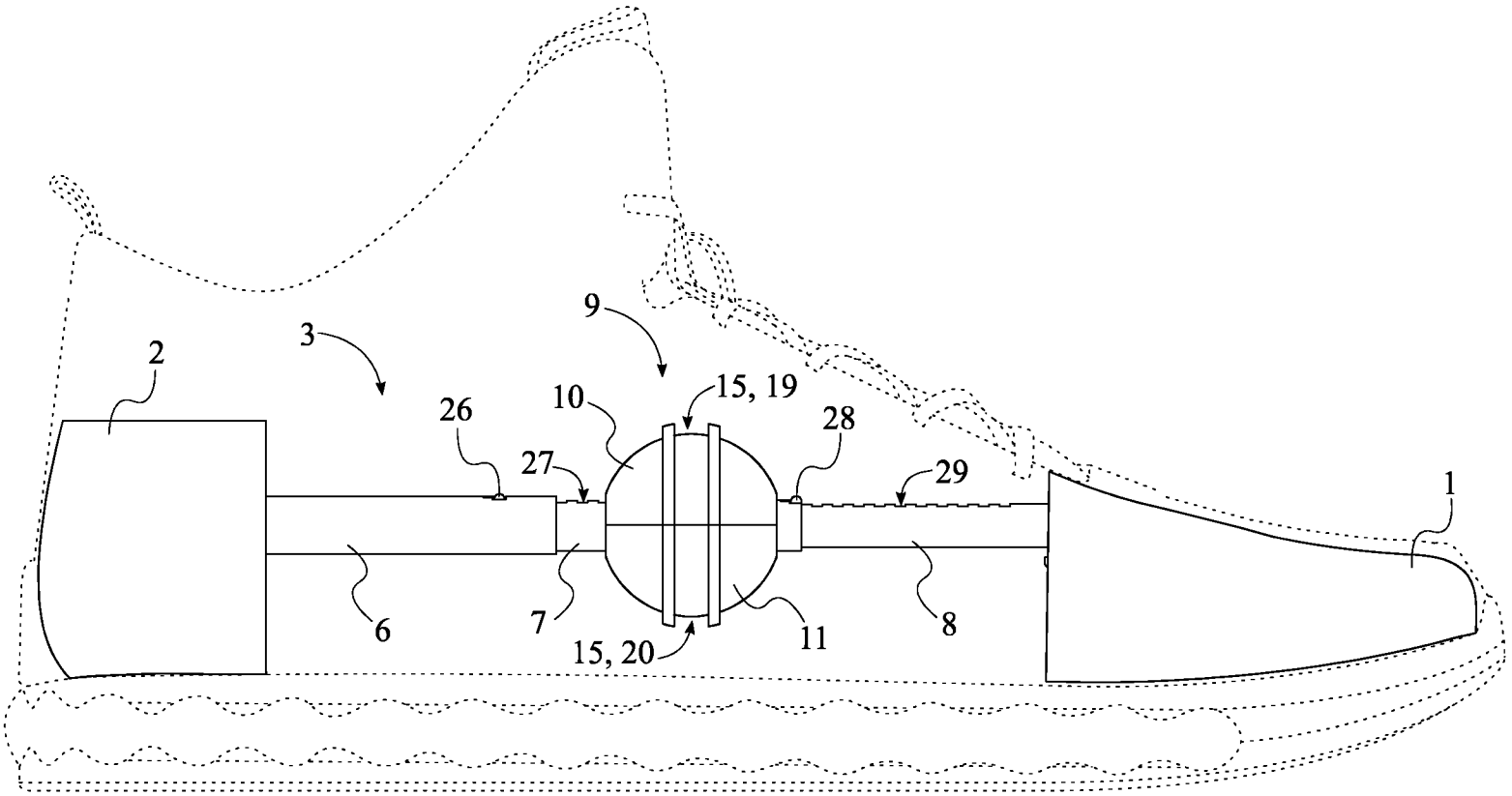
FIG. 3 is a side view showing the present invention, wherein the deodorant housing is shown repositioned along the bridging support.
Figure 4:
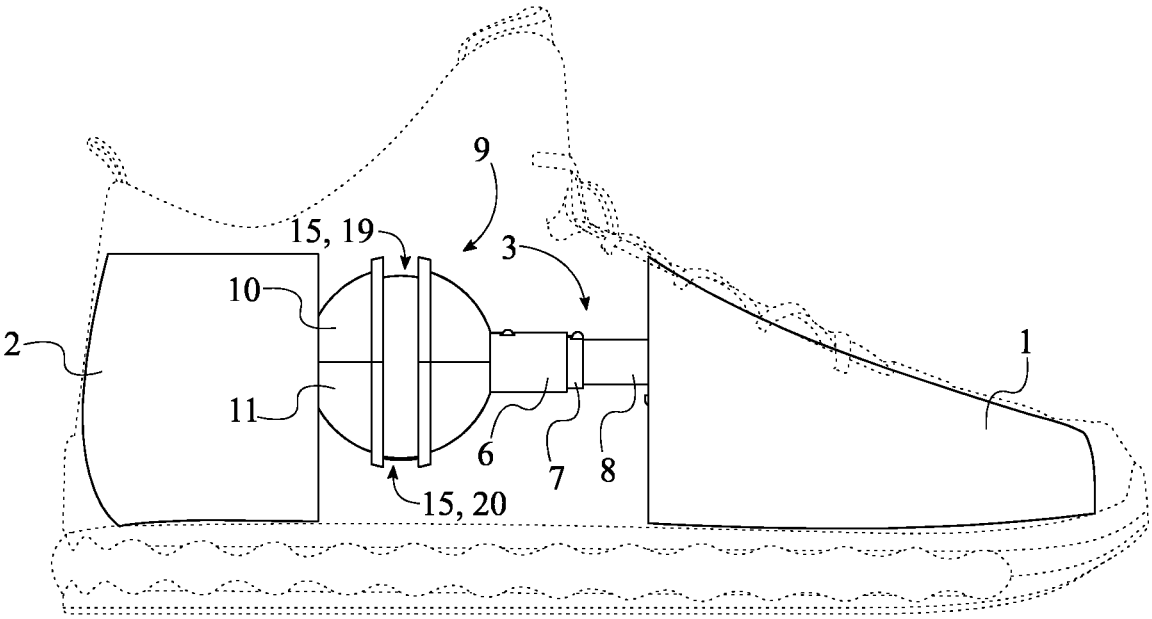
FIG. 4 is a side view showing the present invention, wherein the shoe tree deodorizer is shown shortened to fit a smaller footwear.

The general configuration of the aforementioned components allows the present invention to effectively and efficiently control footwear odors as well as to retain the original structure of the footwear. The toe shaper 1 and the heel shaper 2 can be designed to fit the shape of a desired footwear or can be generically designed to fit most popular footwear. The toe shaper 1 and the heel shaper 2 can also be shaped and decorated to match the overall design of the footwear with the same ornamental decorations such as logos, illustrations, themes, etc. As can be seen in FIGS. 3 and 4, the toe shaper 1 is terminally mounted to the bridging support 3. Similarly, the heel shaper 2 is terminally mounted to the bridging support 3, opposite to the toe shaper 1, thus creating an elongated assembly matching the elongated structure of the footwear. The deodorant housing 9 is movably mounted along the bridging support 3 to enable the user to reposition the deodorant housing 9 to target different areas in the footwear. For example, the user can position the deodorant housing 9 closer to the toe shaper 1 to target the toe area of the footwear. In addition, the deodorant housing 9 is positioned offset from the toe shaper 1 along the bridging support 3 so that the deodorant housing 9 can be moved along the bridging support 3. Likewise, the deodorant housing 9 is positioned offset from the heel shaper 2 along the bridging support 3 to not obstruct the movement of the deodorant housing 9. Furthermore, the at least one ventilation mechanism 15 is operatively integrated into the deodorant housing 9 so that the user can selectively aerate an internal volume of the deodorant housing 9 using the at least one ventilation mechanism 15. The quantity of deodorant 21 is also retained within the deodorant housing 9 so that the quantity of deodorant 21 can be selectively dispersed using the at least one ventilation mechanism 15.

The deodorant housing 9 can be a hollow structure that can be selectively opened so that the user can refill the quantity of deodorant 21 within the deodorant housing 9. As can be seen in FIG. 8 through 11, the deodorant housing 9 is preferably a modular structure that may comprise a first hemispherical shell 10 and a second hemispherical shell 11. The first hemispherical shell 10 and the second hemispherical shell 11 preferably have symmetrical design so that when put together the first hemispherical shell 10 and the second hemispherical shell 11 form a sphere-like structure. In addition, the first hemispherical shell 10 and the second hemispherical shell 11 each comprise a shell body 12, a base rim 13, and a center channel 14. The shell body 12 is preferably a hollow hemispherical structure, with the base rim 13 being formed by the opening of the shell body 12. The center channel 14 allows the shell body 12 to be movably mounted to the bridging support 3 without the use of connectors or mounts. The center channel 14 traverses into the shell body 12 from the base rim 13 so that the center channel 14 is part of the shell body 12. In addition, the center channel 14 is diametrically positioned across the base rim 13 so that the shell body 12 is able to receive the bridging support 3 across the base rim 13. Further, to form the spherical shape of the deodorant housing 9, the base rim 13 of the first hemispherical shell 10 and the base rim 13 of the second hemispherical shell 11 are positioned concentric and coincident to each other. The center channel 14 of the first hemispherical shell 10 and the center channel 14 of the second hemispherical shell 11 are also positioned parallel and coincident to each other so that the two channels form a single symmetrical channel through which the bridging support 3 traverses. The center channel 14 of the first hemispherical shell 10 and the center channel 14 of the second hemispherical shell 11 can be attached to each other via a snap-fit fastening mechanism. In addition, the bridging support 3 is movably mounted through the center channel 14, thus enabling the user to reposition the deodorant housing 9 along the bridging support 3, as necessary. In other embodiments, the deodorant housing 9 can be movably mounted to the bridging support 3 using different mechanisms, such as a hinge mechanism or a clamp mechanism.

The at least one ventilation mechanism 15 is a mechanism that can be manually operated to enable airflow through the deodorant housing 9. As can be seen in FIG. 8 through 11, the at least one ventilation mechanism 15 may comprise an aeration vent 16, a vent cover 17, and cover track 18. The aeration vent 16 enables airflow through the deodorant housing 9, while the vent cover 17 enables the sealing of the aeration vent 16 to selectively stop the airflow through the deodorant housing 9. The cover track 18 enables the movement of the vent cover 17 along the shell body 12 to open and close the aeration vent 16. The cover track 18 is externally connected onto the deodorant housing 9 to keep the vent cover 17 outside the deodorant housing 9. The aeration vent 16 traverses through the cover track 18 and into the deodorant housing 9 to enable airflow through the deodorant housing 9 and the cover track 18. In addition, the aeration vent 16 is positioned perpendicular to the bridging support 3 to not affect the overall structural integrity of the shell body 12. Finally, the vent cover 17 is slidably mounted along the cover track 18 so that the user can move the vent cover 17 along the cover track 18. Thus, the user can readily move the vent cover 17 along the cover track 18 to seal or to unseal the aeration vent 16. For example, in a deodorant-sealing configuration, the vent cover 17 is positioned coextensive with the aeration vent 16 to prevent airflow through the deodorant housing 9. Alternatively, in a deodorant-releasing configuration, the vent cover 17 is positioned offset to the aeration vent 16 to enable airflow through the deodorant housing 9. Thus, the quantity of deodorant 21 is released to the surroundings due to the airflow through the deodorant housing 9. In alternate embodiments, the vent cover 17 and the cover track 18 can be replaced with a removable sealing strip that the user can peel off to expose the quantity of deodorant 21 to the environment and to enable airflow through the deodorant housing 9.

Figure 2:
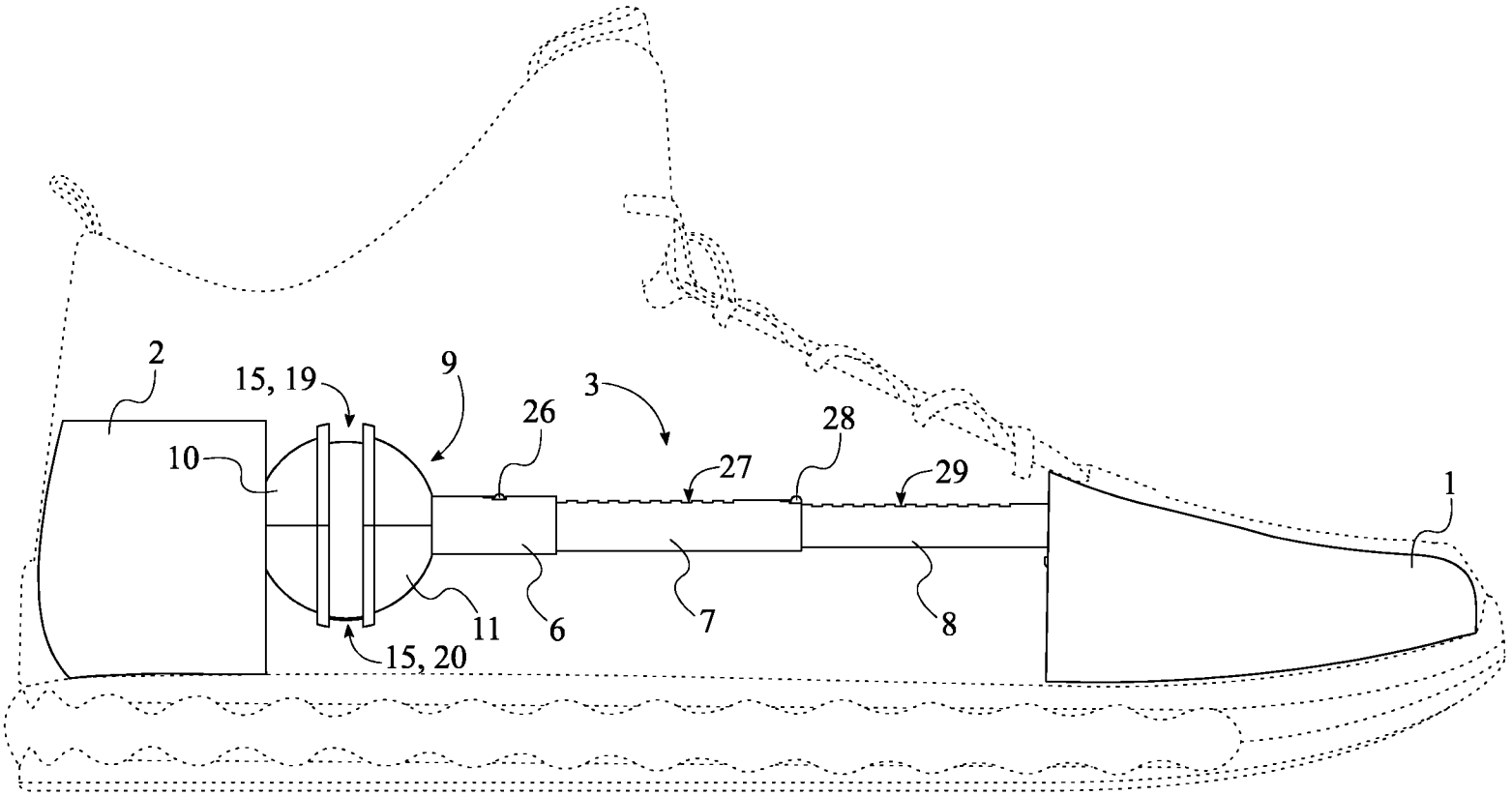
FIG. 2 is a side view showing the present invention, wherein the shoe tree deodorizer is shown within a footwear.
Figure 12:
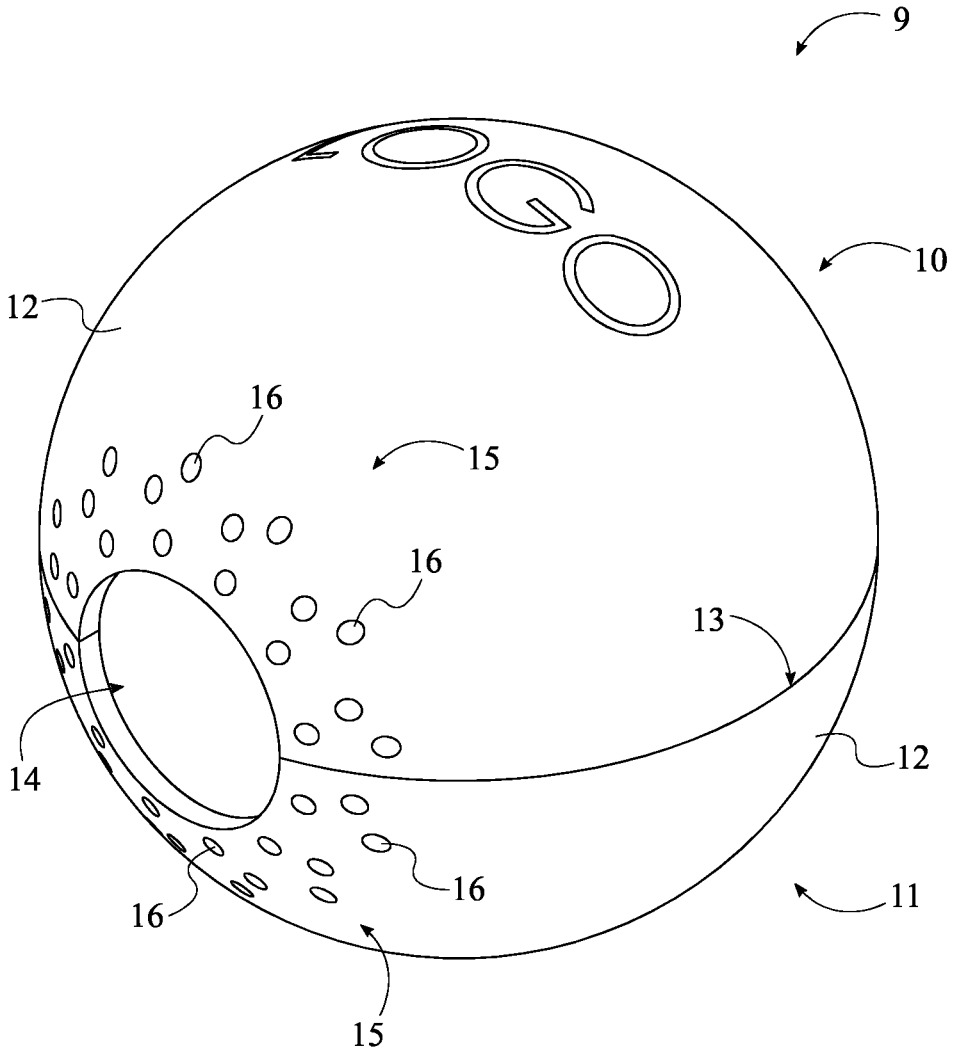
FIG. 12 is an enlarged top perspective view showing the deodorant housing, wherein an alternate embodiment of the at least one ventilation mechanism is shown.

To enable the deodorant to reach the desired areas within the footwear, the at least one ventilation mechanism 15 may be a first ventilation mechanism 19 and a second ventilation mechanism 20 distributed about the deodorant housing 9. As can be seen in FIG. 2 through 4, the first ventilation mechanism 19 and the second ventilation mechanism 20 enable the release of the quantity of deodorant 21 over a greater area to more efficiently deodorize and refreshen the footwear. The first ventilation mechanism 19 and the second ventilation mechanism 20 can also enable the user to target a specific area of the footwear to greatly deodorize and refreshen that area. The first ventilation mechanism 19 and the second ventilation mechanism 20 are positioned opposite to each other about the deodorant housing 9 to reach a wider area surrounding the deodorant housing 9. Therefore, the user can selectively open either the first ventilation mechanism 19 and/or the second ventilation mechanism 20 to target a specific area or a wider area of the footwear. In other embodiments, the at least one ventilation mechanism 15 may include a plurality of aeration vents that can be distributed about the shell body 12 to enable free airflow through the deodorant housing 9, as can be seen in FIG. 12. The plurality of aeration vents can be provided with a removable strip of material that prevents the quantity of deodorant 21 from wearing out before use.

Figure 5:
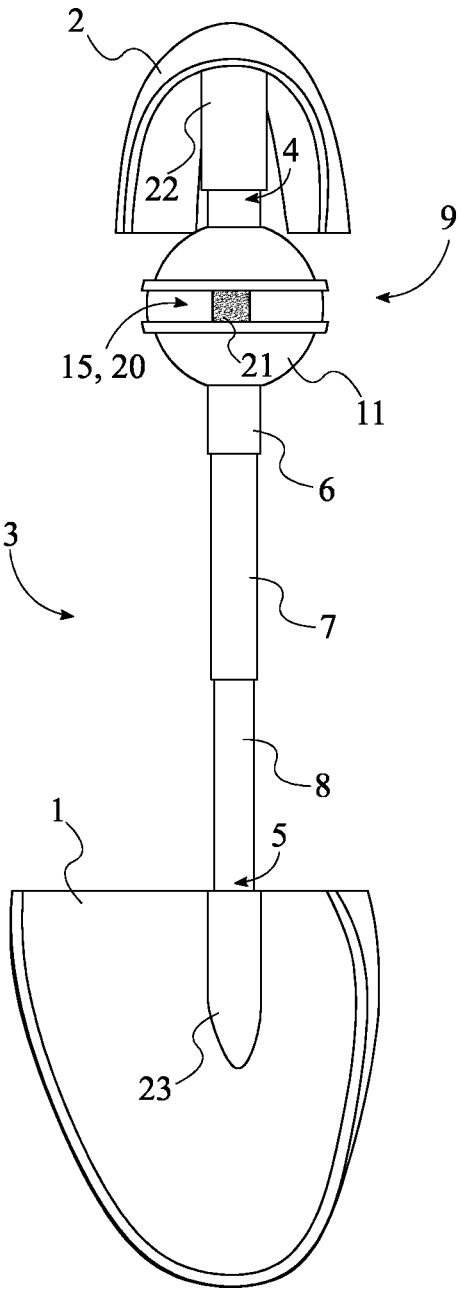
FIG. 5 is a bottom view showing the present invention.
Figure 6:
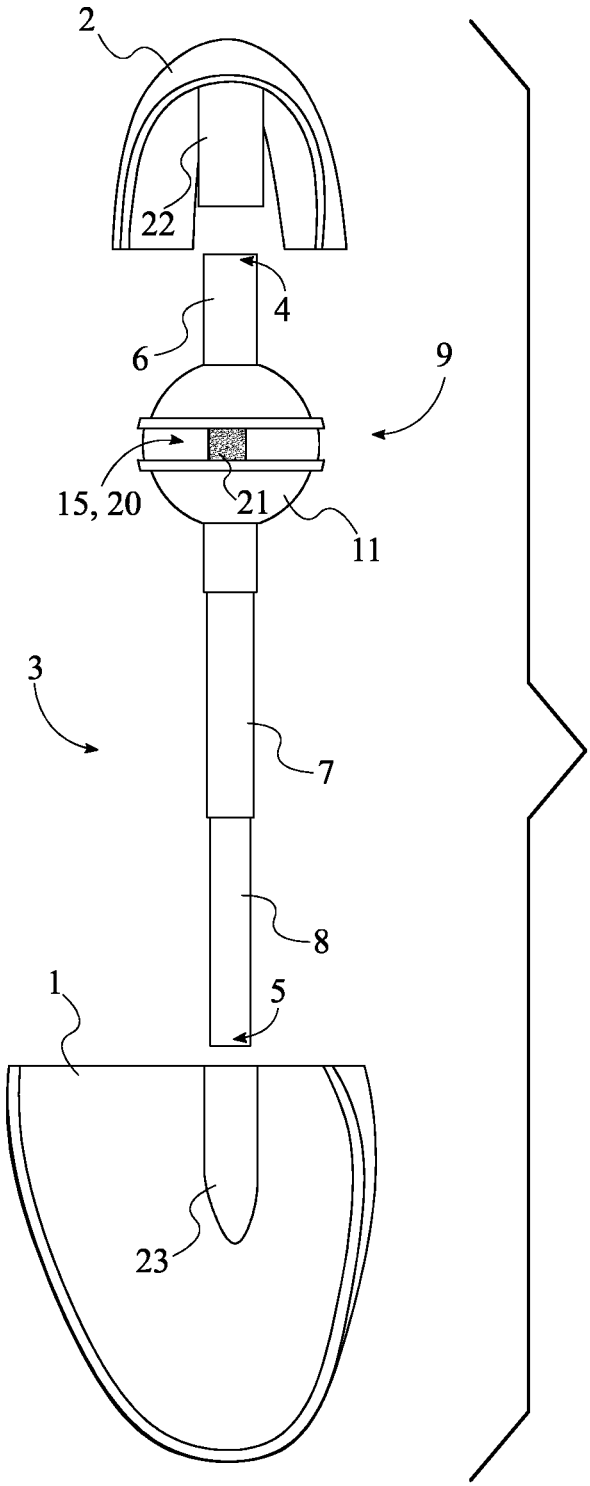
FIG. 6 is a bottom exploded view showing the present invention.

As previously discussed, the heel shaper 2 and the toe shaper 1 are terminally mounted to the bridging support 3 to enable assembling and disassembling of the present invention. As can be seen in FIGS. 5 and 6, to facilitate the assembling and disassembling of the present invention, the present invention may further comprise a heel socket 22 and a toe socket 23 that connect the bridging support 3 to the heel shaper 2 and the toe shaper 1, respectively. In addition, the bridging support 3 may comprise a first support end 4 and a second support end 5 that can be inserted into the heel socket 22 and the toe socket 23. The first support end 4 and the second support end 5 are positioned opposite to each other along the bridging support 3 due to the elongated structure of the bridging support 3. The heel socket 22 is mounted within the heel shaper 2 to receive the first support end 4. Similarly, the toe socket 23 is mounted within the toe shaper 1 to receive the second support end 5. Furthermore, the first support end 4 is attached into the heel socket 22, while the second support end 5 is attached into the toe socket 23. Thus, the user can assemble or disassemble the combination of the heel shaper 2, the toe shaper 1, and the bridging support 3 as desired.

Figure 7:
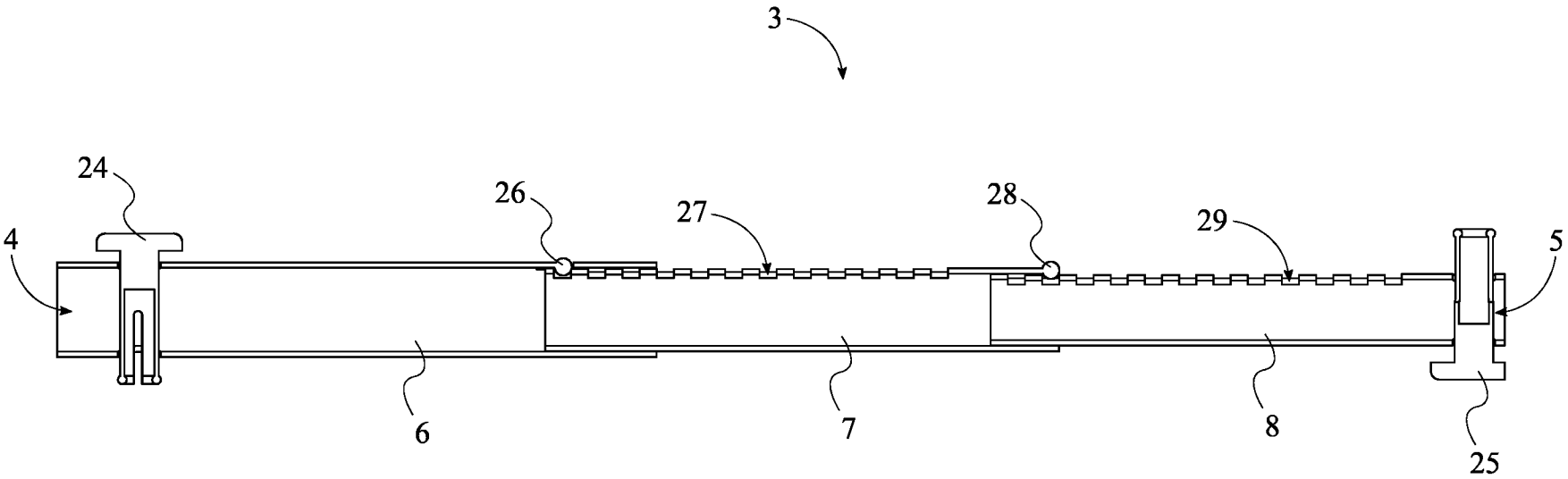
FIG. 7 is a side schematic view showing the bridging support.
Figure 8:
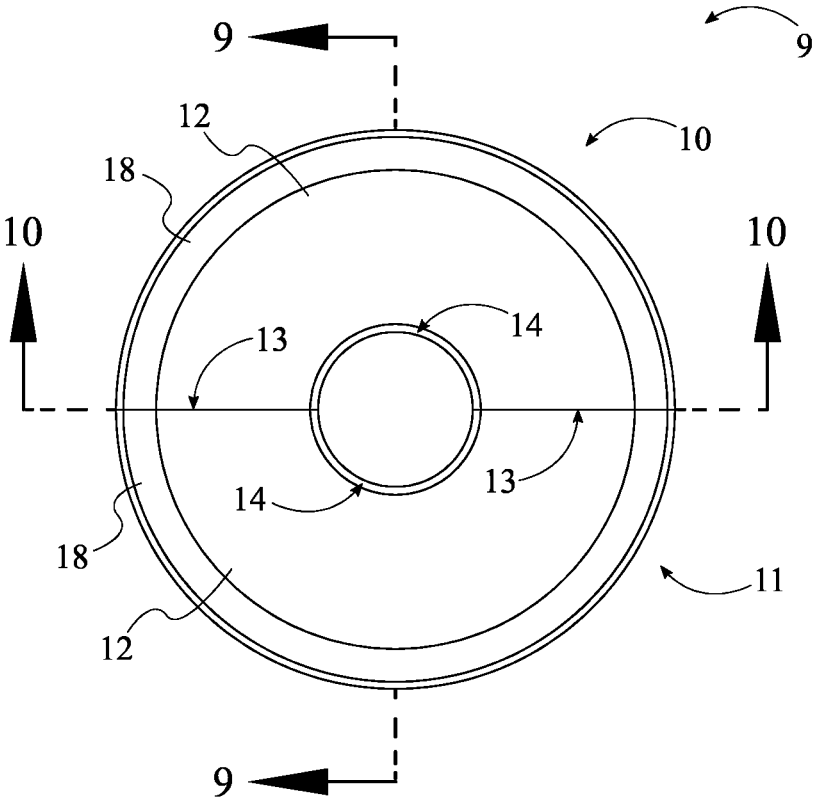
FIG. 8 is an enlarged front view showing the deodorant housing.
Figure 9:
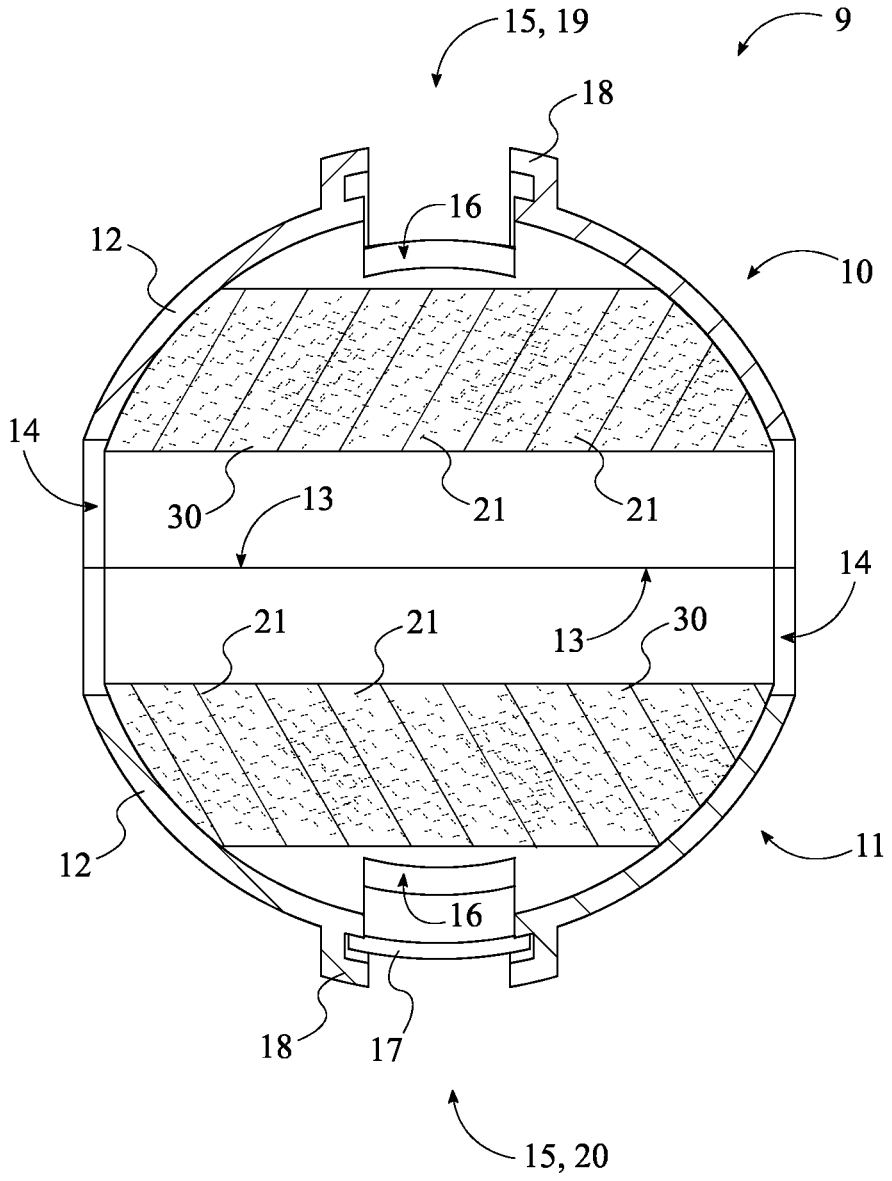
FIG. 9 is an enlarged vertical cross-sectional view taken along line 9-9 in FIG. 8.
Figure 10:
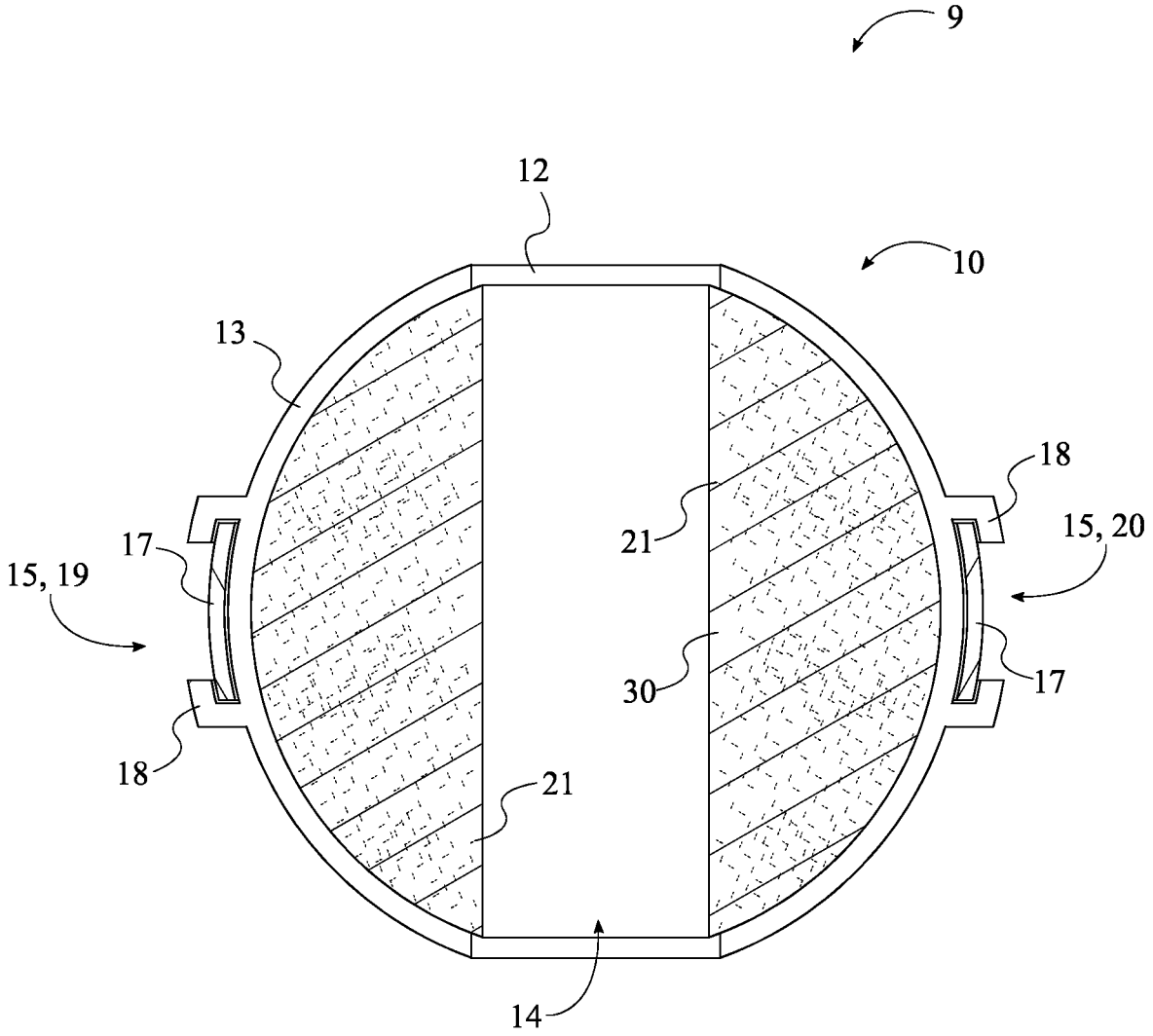
FIG. 10 is an enlarged horizontal cross-sectional view taken along line 10-10 in FIG. 8.

Moreover, to secure the bridging support 3 to either the heel socket 22 and/or the toe socket 23, the present invention may utilize different fastening mechanisms. In one embodiment, the first support end 4 and the second support end 5 may comprise external threading while the heel socket 22, and the toe socket 23 may comprise internal threading. Thus, the user can screw the first support end 4 into the heel socket 22 as well as screw the second support end 5 into the toe socket 23. In another embodiment, the present invention may comprise a first pin lock 24 and a second pin lock 25 that can be used to fasten the bridging support 3 to the heel shaper 2 and the toe shaper 1. As can be seen in FIG. 7, the first pin lock 24 is operatively integrated between the first support end 4 and the heel socket 22 so that the user can readily fasten the first support end 4 in place within the heel socket 22 using the first pin lock 24. For example, the heel socket 22 and the first support end 4 can include a matching through-hole through which the first pin lock 24 can be inserted into. Likewise, the second pin lock 25 is operatively integrated between the second support end 5 and the toe socket 23 so that the user can readily fasten the second support end 5 in place within the toe socket 23 using the second pin lock 25. For example, the toe socket 23 and the second support end 5 can also include a matching through-hole through which the second pin lock 25 can be inserted into. In other embodiments, other fastening mechanisms can be utilized to fasten the bridging support 3 to the heel shaper 2 and the toe shaper 1.

As previously disclosed, the bridging support 3 enables the user to adjust the overall length of the present invention to fit into the footwear, and the bridging support 3 can utilize different mechanisms to do so. As can be seen in FIG. 7, the bridging support 3 is preferably a length-adjustable structure that can be manually adjusted to match the length of the footwear. The bridging support 3 may comprise a first tube 6, an intermediate tube 7, and a second tube 8. The first tube 6, the intermediate tube 7, and the second tube 8 form a telescopic structure that can be elongated or shortened as necessary. The heel shaper 2 is terminally attached to the first tube 6 to connect the bridging support 3 to the heel shaper 2. The intermediate tube 7 is telescopically engaged into the first tube 6, opposite to the heel shaper 2, to enable the intermediate tube 7 to be slid into and out of the first tube 6. Likewise, the second tube 8 is telescopically engaged into the intermediate tube 7, opposite to the first tube 6, to enable the first tube 6 to be slid into and out of the intermediate tube 7. In addition, the toe shaper 1 is terminally attached to the second tube 8, opposite to the intermediate tube 7, to connect the bridging support 3 to the toe shaper 1. Thus, the user can adjust the overall working length of the bridging support 3 by sliding the intermediate tube 7 and/or the second tube 8 into the corresponding tube. Furthermore, the deodorant housing 9 is positioned along the first tube 6 to facilitate the insertion of the present invention into the footwear. However, the deodorant housing 9 can be repositioned as necessary onto the intermediate tube 7 or the second tube 8 to target different areas of the footwear. In another embodiment, the bridging support 3 can be made from elastic material so that the user can squeeze or stretch the bridging support 3 to fit the present invention into the footwear. Alternatively, the bridging support 3 can be provided in different sizes corresponding to different sizes of footwear.

The length adjustment of the bridging support 3 is further facilitated by enabling the user to lock the desired overall working length of the bridging support 3. In addition, by locking the overall working length of the bridging support 3, the toe shaper 1 and the heel shaper 2 better retain the shape of the footwear. To do so, the present invention may further comprise a first pawl 26 and a first ratchet rack 27 that enable the user to lock the intermediate tube 7 in position within the first tube 6, as can be seen in FIGS. 1 and 7. The first pawl 26 is terminally integrated into the first tube 6, opposite to the heel shaper 2, to enable the user to lock the desired working length of the first tube 6 and the intermediate tube 7. In addition, the first ratchet rack 27 is laterally integrated along the intermediate tube 7 to provide means to interlock the intermediate tube 7 with the first tube 6. The first ratchet rack 27 is also engaged by the first pawl 26 to lock the intermediate tube 7 in position within the first tube 6. Thus, the user can incrementally move the intermediate tube 7 along the first tube 6 as necessary to adjust the working length, and the first pawl 26 along with the first ratchet rack 27 would lock the intermediate tube 7 in place inside the first tube 6 without risk of the intermediate tube 7 coming loose unless great force is applied onto either the intermediate tube 7 and/or the first tube 6.

Likewise, the intermediate tube 7 and the second tube 8 may utilize a similar mechanism of length adjustment. The present invention may further comprise a second pawl 28 and a second ratchet rack 29 that enable the user to lock the second tube 8 in position within the intermediate tube 7, as can be seen in FIGS. 1 and 7. The second pawl 28 is terminally integrated into the intermediate tube 7, opposite to the first tube 6, to enable the user to lock the desired overall working length of the intermediate tube 7 and the second tube 8. In addition, the second ratchet rack 29 is laterally integrated along the second tube 8 to provide means to interlock the second tube 8 with the intermediate tube 7. The second ratchet rack 29 is also engaged by the second pawl 28 to lock the second tube 8 in position within the intermediate tube 7. Thus, the user can incrementally move the second tube 8 along the intermediate tube 7 as necessary to adjust the working length, and the second pawl 28 along with the second ratchet rack 29 would lock the second tube 8 in place inside the intermediate tube 7 without risk of the second tube 8 coming loose unless great force is applied onto either the intermediate tube 7 and/or the first tube 6. In other embodiments, different locking mechanisms can be utilized to lock the working length of the bridging support 3.

Figure 11:
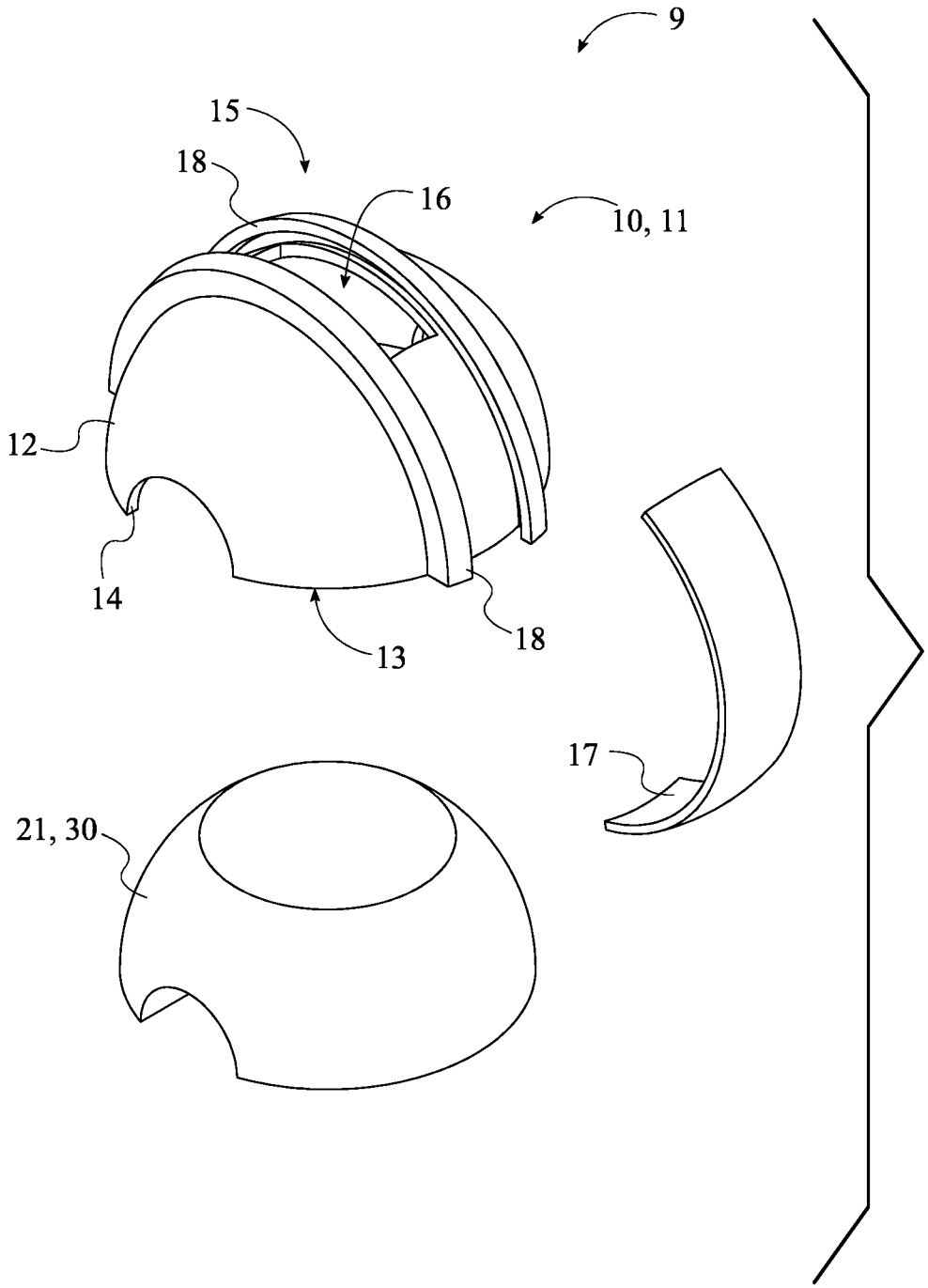
FIG. 11 is a front top exploded perspective view showing a hemispherical shell of the deodorant housing.

Moreover, the quantity of deodorant 21 is preferably able to be replenished after the deodorant material wears out so that the user does not have to replace the whole apparatus. As can be seen in FIG. 11, the present invention may further comprise a foam sponge 30 that retains the quantity of deodorant 21 material. The foam sponge 30 also captures moisture from the footwear to further eliminate odors caused by the trapped moisture in the footwear. The foam sponge 30 is mounted within the deodorant housing 9 to maintain a single structure. In addition, the quantity of deodorant 21 is retained within the foam sponge 30 to prevent leaking of the quantity of deodorant 21. Thus, the quantity of deodorant 21 is kept within the deodorant housing 9 as well as any moisture trapped in the foam sponge 30. In addition, due to the modular structure of the deodorant housing 9, the user can remove the foam sponge 30 from the deodorant housing 9 for cleaning and washing. Further, the user can open the deodorant housing 9 or the at least one ventilation mechanism 15 to replenish the quantity of deodorant 21 in the foam sponge 30. The deodorant material of the quantity of deodorant 21 can be provided as a liquid material with any desired fragrance. In other embodiments, the quantity of deodorant 21 can be provided in solid state without the need of the foam sponge 30.

Although the invention has been explained in relation to its preferred embodiment, it is to be understood that many other possible modifications and variations can be made without departing from the spirit and scope of the invention as hereinafter claimed.

What is claimed is:

1. A shoe tree deodorizer comprising:

a toe shaper;

a heel shaper;

a bridging support;

a deodorant housing;

at least one ventilation mechanism;

a quantity of deodorant;

the toe shaper being terminally mounted to the bridging support;

the heel shaper being terminally mounted to the bridging support, opposite to the toe shaper;

the deodorant housing being movably mounted along the bridging support;

the deodorant housing being positioned offset from the toe shaper along the bridging support;

the deodorant housing being positioned offset from the heel shaper along the bridging support;

the at least one ventilation mechanism being operatively integrated into the deodorant housing, wherein the at least one ventilation mechanism is used to selectively aerate an internal volume of the deodorant housing; and, the quantity of deodorant being retained within the deodorant housing.

2. The shoe tree deodorizer as claimed in claim 1 comprising:

the deodorant housing comprising a first hemispherical shell and a second hemispherical shell;

the first hemispherical shell and the second hemispherical shell each comprising a shell body, a base rim, and a center channel;

the center channel traversing into the shell body from the base rim;

the center channel being diametrically positioned across the base rim;

the base rim of the first hemispherical shell and the base rim of the second hemispherical shell being positioned concentric and coincident to each other;

the center channel of the first hemispherical shell and the center channel of the second hemispherical shell being positioned parallel and coincident to each other; and, the bridging support being movably mounted through the center channel.

3. The shoe tree deodorizer as claimed in claim 1 comprising:

the at least one ventilation mechanism comprising an aeration vent, a vent cover, and a cover track;

the cover track being externally connected onto the deodorant housing;

the aeration vent traversing through the cover track and into the deodorant housing;

the aeration vent being positioned perpendicular to the bridging support; and, the vent cover being slidably mounted along the cover track.

4. The shoe tree deodorizer as claimed in claim 3 comprising:

the at least one ventilation mechanism being a first ventilation mechanism and a second ventilation mechanism; and, the first ventilation mechanism and the second ventilation mechanism being positioned opposite to each other about the deodorant housing.

5. The shoe tree deodorizer as claimed in claim 1 comprising:

a heel socket;

a toe socket;

the bridging support comprising a first support end and a second support end;

the first support end and second support end being positioned opposite to each other along the bridging support;

the heel socket being mounted within the heel shaper;

the toe socket being mounted within the toe shaper;

the first support end being attached into the heel socket; and, the second support end being attached into the toe socket.

6. The shoe tree deodorizer as claimed in claim 5 comprising:

a first pin lock;

a second pin lock;

the first pin lock being operatively integrated between the first support end and the heel socket, wherein the first pin lock is used to selectively fasten the first support end in place within the heel socket; and, the second pin lock being operatively integrated between the second support end and the toe socket, wherein the second pin lock is used to selectively fasten the second support end in place within the toe socket.

7. The shoe tree deodorizer as claimed in claim 1 comprising:

the bridging support comprising a first tube, an intermediate tube, and a second tube;

the heel shaper being terminally attached to the first tube;

the intermediated tube being telescopically engaged into the first tube, opposite to the heel shaper;

the second tube being telescopically engaged into the intermediate tube, opposite to the first tube;

the toe shaper being terminally attached to the second tube, opposite to the intermediate tube; and, the deodorant housing being positioned along the first tube.

8. The shoe tree deodorizer as claimed in claim 7 comprising:

a first pawl;

a first ratchet rack;

the first pawl being terminally integrated into the first tube, opposite the heel shaper;

the first ratchet rack being laterally integrated along the intermediate tube; and, the first ratchet rack being engaged by the first pawl.

9. The shoe tree deodorizer as claimed in claim 7 comprising:

a second pawl;

a second ratchet rack;

the second pawl being terminally integrated into the intermediate tube, opposite the first tube;

the second ratchet rack being laterally integrated along the second tube; and, the second ratchet rack being engaged by the second pawl.

10. The shoe tree deodorizer as claimed in claim 1 comprising:

a foam sponge;

the foam sponge being mounted within the deodorant housing; and, the quantity of deodorant being retained within the foam sponge.

11. A shoe tree deodorizer comprising:

a toe shaper;

a heel shaper;

a bridging support;

a deodorant housing;

at least one ventilation mechanism;

a quantity of deodorant;

the deodorant housing comprising a first hemispherical shell and a second hemispherical shell;

the first hemispherical shell and the second hemispherical shell each comprising a shell body, a base rim, and a center channel;

the toe shaper being terminally mounted to the bridging support;

the heel shaper being terminally mounted to the bridging support, opposite to the toe shaper;

the deodorant housing being movably mounted along the bridging support;

the deodorant housing being positioned offset from the toe shaper along the bridging support;

the deodorant housing being positioned offset from the heel shaper along the bridging support;

the at least one ventilation mechanism being operatively integrated into the deodorant housing, wherein the at least one ventilation mechanism is used to selectively aerate an internal volume of the deodorant housing;

the quantity of deodorant being retained within the deodorant housing;

the center channel traversing into the shell body from the base rim;

the center channel being diametrically positioned across the base rim;

the base rim of the first hemispherical shell and the base rim of the second hemispherical shell being positioned concentric and coincident to each other;

the center channel of the first hemispherical shell and the center channel of the second hemispherical shell being positioned parallel and coincident to each other; and, the bridging support being movably mounted through the center channel.

12. The shoe tree deodorizer as claimed in claim 11 comprising:

the at least one ventilation mechanism comprising an aeration vent, a vent cover, and a cover track;

the at least one ventilation mechanism being a first ventilation mechanism and a second ventilation mechanism;

the cover track being externally connected onto the deodorant housing;

the aeration vent traversing through the cover track and into the deodorant housing;

the aeration vent being positioned perpendicular to the bridging support;

the vent cover being slidably mounted along the cover track; and, the first ventilation mechanism and the second ventilation mechanism being positioned opposite to each other about the deodorant housing.

13. The shoe tree deodorizer as claimed in claim 11 comprising:

a heel socket;

a toe socket;

a first pin lock;

a second pin lock;

the bridging support comprising a first support end and a second support end;

the first support end and second support end being positioned opposite to each other along the bridging support;

the heel socket being mounted within the heel shaper;

the toe socket being mounted within the toe shaper;

the first support end being attached into the heel socket;

the second support end being attached into the toe socket;

the first pin lock being operatively integrated between the first support end and the heel socket, wherein the first pin lock is used to selectively fasten the first support end in place within the heel socket; and, the second pin lock being operatively integrated between the second support end and the toe socket, wherein the second pin lock is used to selectively fasten the second support end in place within the toe socket.

14. The shoe tree deodorizer as claimed in claim 11 comprising:

the bridging support comprising a first tube, an intermediate tube, and a second tube;

the heel shaper being terminally attached to the first tube;

the intermediated tube being telescopically engaged into the first tube, opposite to the heel shaper;

the second tube being telescopically engaged into the intermediate tube, opposite to the first tube;

the toe shaper being terminally attached to the second tube, opposite to the intermediate tube; and, the deodorant housing being positioned along the first tube.

15. The shoe tree deodorizer as claimed in claim 14 comprising:

a first pawl;

a first ratchet rack;

a second pawl;

a second ratchet rack;

the first pawl being terminally integrated into the first tube, opposite the heel shaper;

the first ratchet rack being laterally integrated along the intermediate tube;

the first ratchet rack being engaged by the first pawl;

the second pawl being terminally integrated into the intermediate tube, opposite the first tube;

the second ratchet rack being laterally integrated along the second tube; and, the second ratchet rack being engaged by the second pawl.

16. The shoe tree deodorizer as claimed in claim 11 comprising:

a foam sponge;

the foam sponge being mounted within the deodorant housing; and, the quantity of deodorant being retained within the foam sponge.

17. A shoe tree deodorizer comprising:

a toe shaper;

a heel shaper;

a bridging support;
a deodorant housing;
at least one ventilation mechanism;
a quantity of deodorant;
a foam sponge;
the deodorant housing comprising a first hemispherical shell and a second hemispherical shell;
the first hemispherical shell and the second hemispherical shell each comprising a shell body, a base rim, and a center channel;
the toe shaper being terminally mounted to the bridging support;
the heel shaper being terminally mounted to the bridging support, opposite to the toe shaper;
the deodorant housing being movably mounted along the bridging support;
the deodorant housing being positioned offset from the toe shaper along the bridging support;
the deodorant housing being positioned offset from the heel shaper along the bridging support;
the at least one ventilation mechanism being operatively integrated into the deodorant housing, wherein the at least one ventilation mechanism is used to selectively aerate an internal volume of the deodorant housing;
the quantity of deodorant being retained within the deodorant housing;
the center channel traversing into the shell body from the base rim;
the center channel being diametrically positioned across the base rim;
the base rim of the first hemispherical shell and the base rim of the second hemispherical shell being positioned concentric and coincident to each other;
the center channel of the first hemispherical shell and the center channel of the second hemispherical shell being positioned parallel and coincident to each other;
the bridging support being movably mounted through the center channel;
the foam sponge being mounted within the deodorant housing; and,
the quantity of deodorant being retained within the foam sponge.

18. The shoe tree deodorizer as claimed in claim 17 comprising:
the at least one ventilation mechanism comprising an aeration vent, a vent cover, and a cover track;
the at least one ventilation mechanism being a first ventilation mechanism and a second ventilation mechanism;
the cover track being externally connected onto the deodorant housing;
the aeration vent traversing through the cover track and into the deodorant housing;
the aeration vent being positioned perpendicular to the bridging support;
the vent cover being slidably mounted along the cover track; and,
the first ventilation mechanism and the second ventilation mechanism being positioned opposite to each other about the deodorant housing.

19. The shoe tree deodorizer as claimed in claim 17 comprising:
a heel socket;
a toe socket;
a first pin lock;
a second pin lock;
the bridging support comprising a first support end and a second support end;
the first support end and second support end being positioned opposite to each other along the bridging support;
the heel socket being mounted within the heel shaper;
the toe socket being mounted within the toe shaper;
the first support end being attached into the heel socket;
the second support end being attached into the toe socket;
the first pin lock being operatively integrated between the first support end and the heel socket, wherein the first pin lock is used to selectively fasten the first support end in place within the heel socket; and,
the second pin lock being operatively integrated between the second support end and the toe socket, wherein the second pin lock is used to selectively fasten the second support end in place within the toe socket.

20. The shoe tree deodorizer as claimed in claim 17 comprising:
a first pawl;
a first ratchet rack;
a second pawl;
a second ratchet rack;
the bridging support comprising a first tube, an intermediate tube, and a second tube;
the heel shaper being terminally attached to the first tube;
the intermediated tube being telescopically engaged into the first tube, opposite to the heel shaper;
the second tube being telescopically engaged into the intermediate tube, opposite to the first tube;
the toe shaper being terminally attached to the second tube, opposite to the intermediate tube;
the deodorant housing being positioned along the first tube;
the first pawl being terminally integrated into the first tube, opposite the heel shaper;
the first ratchet rack being laterally integrated along the intermediate tube;
the first ratchet rack being engaged by the first pawl;
the second pawl being terminally integrated into the intermediate tube, opposite the first tube;
the second ratchet rack being laterally integrated along the second tube; and,
the second ratchet rack being engaged by the second pawl.

* * * * *